US009429909B2

(12) United States Patent
Shirai et al.

(10) Patent No.: US 9,429,909 B2
(45) Date of Patent: Aug. 30, 2016

(54) IMAGE FORMING APPARATUS

(71) Applicants: Takaaki Shirai, Tokyo (JP); Satoru Tao, Kanagawa (JP); Takuma Kasai, Kanagawa (JP); Norikazu Okada, Kanagawa (JP); Homare Ehara, Kanagawa (JP); Keita Maejima, Kanagawa (JP); Tomoyuki Yamashita, Tokyo (JP); Ryohta Kubokawa, Kanagawa (JP)

(72) Inventors: Takaaki Shirai, Tokyo (JP); Satoru Tao, Kanagawa (JP); Takuma Kasai, Kanagawa (JP); Norikazu Okada, Kanagawa (JP); Homare Ehara, Kanagawa (JP); Keita Maejima, Kanagawa (JP); Tomoyuki Yamashita, Tokyo (JP); Ryohta Kubokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/579,211

(22) Filed: Dec. 22, 2014

(65) Prior Publication Data

US 2015/0177684 A1 Jun. 25, 2015

(30) Foreign Application Priority Data

Dec. 25, 2013 (JP) ..... 2013-267521

(51) Int. Cl.

| | |
|---|---|
| ***G03G 15/20*** | (2006.01) |
| ***G03G 21/20*** | (2006.01) |
| ***G03G 15/00*** | (2006.01) |

(52) U.S. Cl.

CPC ..... *G03G 21/206* (2013.01); *G03G 15/2017* (2013.01); *G03G 15/2039* (2013.01); *G03G 15/5004* (2013.01); *G03G 15/80* (2013.01)

(58) Field of Classification Search

CPC ..... G03G 15/2017; G03G 15/2039; G03G 15/2078; G03G 21/206

See application file for complete search history.

(56) References Cited

U.S. PATENT DOCUMENTS

2011/0317457 A1 12/2011 Shirai

FOREIGN PATENT DOCUMENTS

| | | | |
|---|---|---|---|
| JP | 61034573 A | * | 2/1986 |
| JP | 2001056620 A | * | 2/2001 |
| JP | 2002-229395 | | 8/2002 |
| JP | 2003-015479 | | 1/2003 |
| JP | 2005-137159 | | 5/2005 |
| JP | 2007-072019 | | 3/2007 |
| JP | 2007-112583 | | 5/2007 |

(Continued)

OTHER PUBLICATIONS

Sugita et al. (JP 2010-054961 A) Jan. 2006, JPO Computer Translation.*

*Primary Examiner* — Erika J Villaluna

(74) *Attorney, Agent, or Firm* — Harness, Dickey & Pierce

(57) ABSTRACT

An image forming apparatus includes a heat-generating component, a power generation device including a thermoelectric element, a heat radiation device, a cooling device, a temperature detector that detects a temperature increase of the heat-generating component, and a controller. The heat radiation device includes a first radiator plate interposed between the heat-generating component and a surface of the thermoelectric element and a second radiator plate attached to another surface of the thermoelectric element. The cooling device cools the first radiator plate. The controller controls operations of the cooling device and the power generation device by operating the cooling device if the detected temperature increase reaches at least a predetermined threshold value, and causing the power generation device to generate power without operating the cooling device to cool the first radiator plate passively if the detected temperature increase falls below the predetermined threshold value.

18 Claims, 6 Drawing Sheets

(56) References Cited

FOREIGN PATENT DOCUMENTS

| | | | |
|---|---|---|---|
| JP | 2007-286444 | | 11/2007 |
| JP | 2009036852 | A * | 2/2009 |
| JP | 2009-118067 | | 5/2009 |
| JP | 2009-267974 | | 11/2009 |
| JP | 2010054961 | A * | 3/2010 |
| JP | 2010-169873 | | 8/2010 |
| JP | 2011-180261 | | 9/2011 |
| JP | 2012-008943 | | 1/2012 |
| JP | 2013-127704 | | 6/2013 |

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2013-267521, filed on Dec. 25, 2013, in the Japan Patent Office, the entire disclosure of which is hereby incorporated by reference herein.

BACKGROUND

1. Technical Field

This disclosure relates to an image forming apparatus using an electrophotographic process and is applicable to a copier, a printer, a facsimile machine, and a multifunction peripheral combining the functions of these apparatuses, and more particularly to an image forming apparatus capable of reducing power consumption in response to a demand for energy efficiency by collecting heat generated in the image forming apparatus, converting the heat into electrical energy, storing the electrical energy, and generating power with the stored electrical energy in a sleep state.

2. Related Art

A typical technology applicable to power generation using a heat-generating component of an image forming apparatus and cooling of the heat-generating component is, for example, a power generator that continuously and stably generates power using a thermoelectric conversion element.

SUMMARY

In one embodiment of this disclosure, there is provided an improved image forming apparatus that, in one example, includes a heat-generating component, a power generation device, a heat radiation device, a cooling device, a temperature detector, and a controller. The power generation device includes a thermoelectric element. The heat radiation device includes a first radiator plate interposed between the heat-generating component and a first surface of the thermoelectric element and a second radiator plate attached to a second surface of the thermoelectric element opposite the first surface. The temperature detector detects a temperature increase of the heat-generating component. The controller controls operations of the cooling device and the power generation device by operating the cooling device if the detected temperature increase reaches at least a predetermined threshold value, and causing the power generation device to generate power without operating the cooling device to cool the first heat radiator plate passively if the detected temperature increase falls below the predetermined threshold value.

In one embodiment of this disclosure, there is provided another improved image forming apparatus that, in one example, includes a heat-generating component, a power generation device, a heat radiation device, a cooling device, and a controller. The power generation device includes a thermoelectric element. The heat radiation device includes a first radiator plate interposed between the heat-generating component and a first surface of the thermoelectric element and a second radiator plate attached to a second surface of the thermoelectric element opposite the first surface. The cooling device cools the first radiator plate. The controller predicts a temperature increase of the heat-generating component from a control state of the image forming apparatus assumed to be related to the temperature increase. The controller controls operations of the cooling device and the power generation device by operating the cooling device if the predicted temperature increase reaches at least a predetermined threshold value, and causing the power generation device to generate power without operating the cooling device to cool the first heat radiator plate passively if the predicted temperature increase falls below the predetermined threshold value.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1:
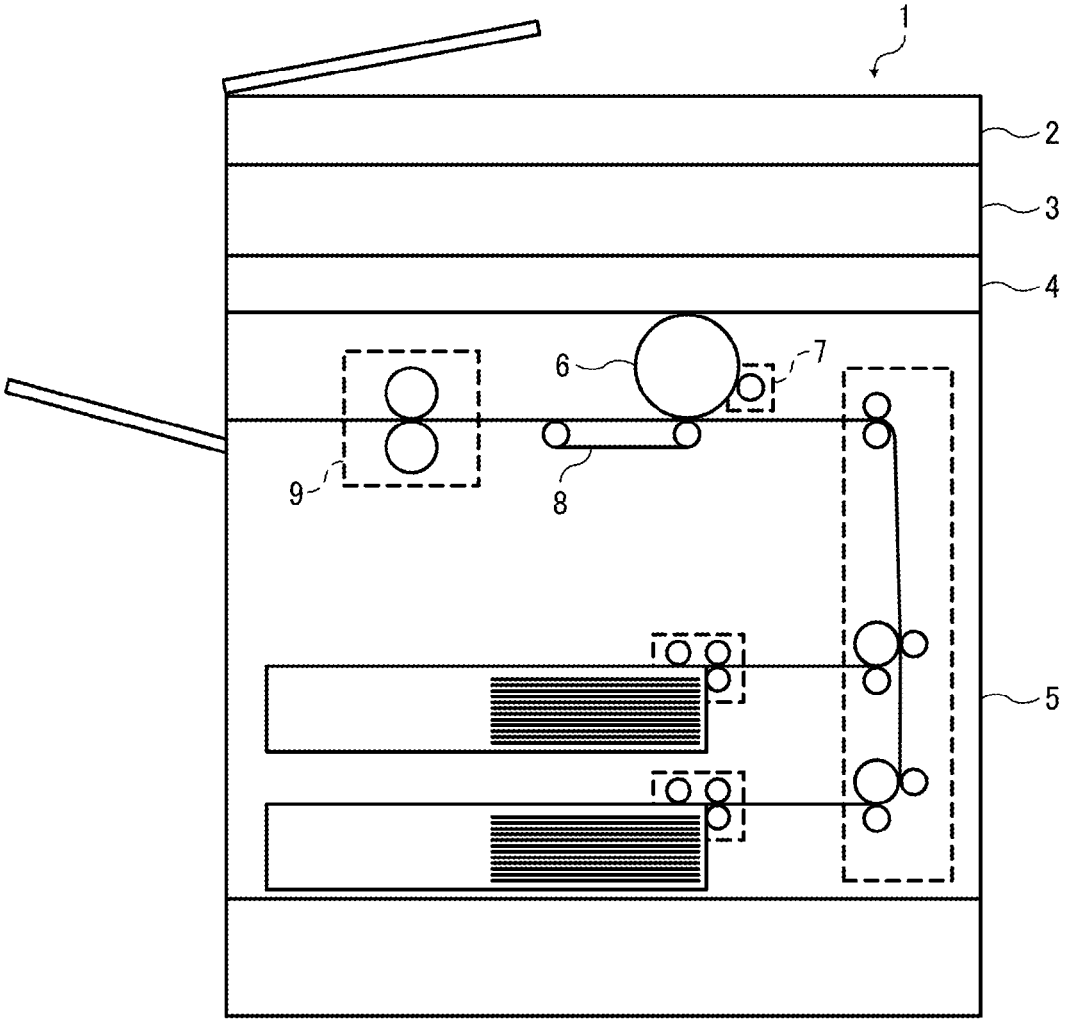
FIG. 1 is a schematic diagram illustrating a basic configuration of a mechanical system of an image forming apparatus according to a first embodiment of this disclosure.

In describing the embodiments illustrated in the drawings, specific terminology is adopted for clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, image forming apparatuses according to embodiments of this disclosure will be described.

A first embodiment of this disclosure will now be described.

FIG. 1 is a schematic diagram illustrating a basic configuration of a mechanical system of an image forming apparatus 1 according to the first embodiment of this disclosure. In the present embodiment, the image forming apparatus 1 is a digital multifunction peripheral having functions such as a copy function, a print function, a facsimile function. The functions are sequentially selectable with an application switch key of a later-described operation unit 40 in the image forming apparatus 1. For example, the image forming apparatus 1 shifts to a copy mode upon selection of the copy function, a print mode upon selection of the print function, and a facsimile mode upon selection of the facsimile function.

Specifically, when the image forming apparatus 1 in FIG. 1 is in the copy mode, an automatic document feeder (ADF) 2 sequentially feeds a bundle of documents to an image reader 3, which then reads image information from the documents. A writing unit 4 serving as a writing device converts the read image information into optical information with an image processor. A photoconductor drum 6 in a printer unit 5 is uniformly charged by a charger and exposed with the optical information from the writing unit 4, to thereby form an electrostatic latent image on the photoconductor drum 6. A developing device 7 develops the electrostatic latent image on the photoconductor drum 6 to form a toner image. A transport belt 8 transports a transfer sheet (also referred to as a recording sheet or recording medium, for example) to transfer the toner image from the photoconductor drum 6 onto the transfer sheet. A fixing device 9 fixes the toner image on the transfer sheet. The transfer sheet is then discharged to the outside of the image forming apparatus 1.

Figure 2:
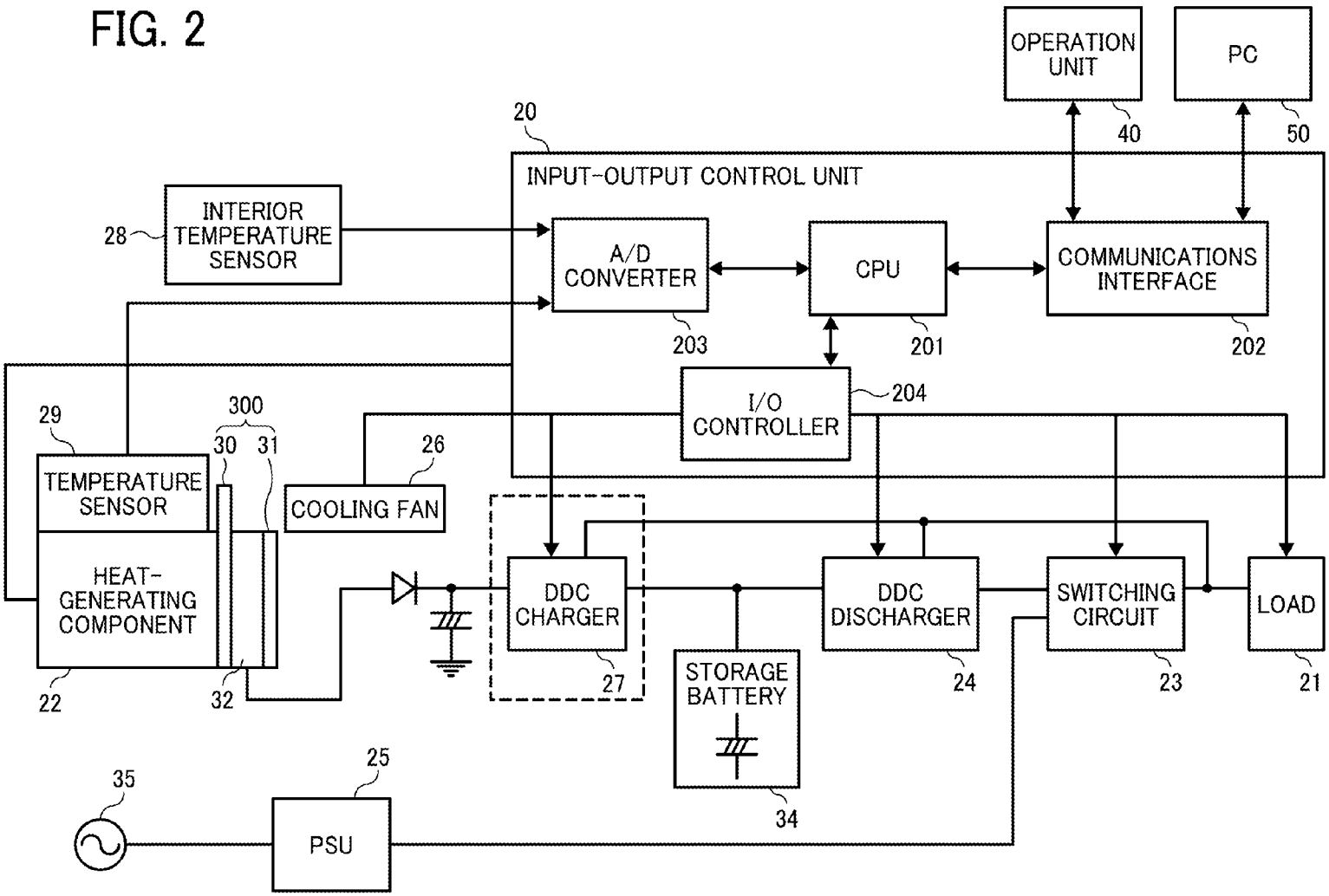
FIG. 2 is a schematic block diagram illustrating a basic configuration of a power supply system of the image forming apparatus illustrated in FIG. 1.

FIG. 2 is a schematic block diagram illustrating a basic configuration of a power supply system of the image forming apparatus 1. As illustrated in FIG. 2, the image forming apparatus 1 includes, as a power supply system, a heat radiation device 300, a cooling fan 26, a temperature sensor 29, and an input-output control unit 20. The heat radiation device 300 includes an air-cooled first radiator plate 30 and a second radiator plate 31. The first radiator plate 30 is interposed between a heat-generating component 22 and one surface of a thermoelectric element 32 serving as a power generation device. The second radiator plate 31 is attached to the other surface of the thermoelectric element 32.

The cooling fan 26 serves as a cooling device that cools the first radiator plate 30. The temperature sensor 29 serves as a temperature detector that detects a temperature increase of the heat-generating component 22. The input-output control unit 20 (specifically, a later-described CPU 201) serves as a controller that controls the operations of the cooling fan 26 and the thermoelectric element 32, specifically, operating the cooling fan 26 if the temperature increase detected by the temperature sensor 29 equals or exceeds a predetermined threshold value, and causing the thermoelectric element 32 to generate power without operating the cooling fan 26 to cool the first heat radiator plate 30 passively if the detected temperature increase is less than the predetermined threshold value.

The input-output control unit 20 is connected to an operation unit 40 and a personal computer (PC) 50. The operation unit 40 is a so-called control panel (operation panel) provided to a typical multifunction peripheral (i.e., the image forming apparatus 1 in the present embodiment). The PC 50 is a typical computer that issues a print command to the image forming apparatus 1 via a network. The input-output control unit 20 includes a central processing unit (CPU) 201, a communications interface 202, an analog/digital (A/D) convertor 203, an input-output (I/O) controller 204. The A/D converter 203 converts analog values of temperature information received from an interior temperature sensor 28 and the temperature sensor 29 into digital values. The communications interface 202 receives print information from the operation unit 40 or the PC 50. The I/O controller 204 controls input and output ports in accordance with commands from the CPU 201. The CPU 201 performs arithmetic operations with input information.

As illustrated in FIG. 2, the communications interface 202 receives the print command from the operation unit 40 or the PC 50. The print command includes image data to be printed, information about the number of prints to be produced, the type of sheets to be printed (e.g., plain paper or high-quality paper), the thickness of the sheets, and the print mode (e.g., color or monochrome, intensive print, and duplex print), and a variety of instructions concerning image formation. The CPU 201 recognizes the number of prints by extracting the information thereof from the print command. Further, the CPU 201 similarly recognizes the thickness of the sheets and the print mode by extracting the information thereof from the print command. As well as the controller, the CPU 201 also implements the functions of a print number detector, a sheet thickness detector, and a print mode recognition device, descriptions of which are deferred.

In the present embodiment, the thermoelectric element 32 is installed to the heat-generating component 22 with the air-cooled first radiator plate 30 interposed therebetween. Thermal energy discharged from the heat-generating component 22 and conducted to the thermoelectric element 32 through the first radiator plate 30 is converted into electrical energy by the thermoelectric element 32.

The electrical energy generated by the thermoelectric element 32 is stored in a storage battery 34 via a direct-current/direct-current converter (DDC) charger 27. If the DDC charger 27 is turned off, the thermoelectric element 32 and the DDC charger 27 are disconnected from each other, thus stopping power generation by the thermoelectric element 32. The electrical energy stored in the storage battery 34 is supplied to a load 21 via a DDC discharger 24 and a switching circuit 23. Since the present embodiment requires a power supply for operating the DDC charger 27, the DDC discharger 24, and the switching circuit 23, a power supply line extending from a power supply unit (PSU) 25 connected to an alternating-current (AC) power supply 35 is connected to the switching circuit 23. With this configuration, the switching circuit 23 switches, under the control of the input-output control unit 20, between power from a main power supply based on AC power supplied from the PSU 25 and power generated by the thermoelectric element 32, stored in the storage battery 34, and discharged by the DDC discharger 24, and supplies the selected power to the load 21.

As well as the above-described control of the operations of the cooling fan 26 and the thermoelectric element 32 based on the temperature increase detected by the temperature sensor 29 attached to the heat-generating component 22, the input-output control unit 20 performs other controls. For example, the input-output control unit 20 controls the operation of the cooling fan 26 based on an interior temperature detected by the interior temperature sensor 28 that detects the temperature of the interior of the image forming apparatus 1 as necessary. Further, the input-output control unit 20 controls the image forming apparatus 1 as a whole based on respective readings obtained from a variety of other sensors, and operates various respective units (functions) of the image forming apparatus 1 that serve as the load 21 in accordance with the operation mode. The input-output control unit 20 also controls the charging operation of the DDC charger 27 to the storage battery 34 and the discharging operation of the DDC discharger 24 from the storage battery 34, and operates the DDC charger 27 to perform the charging operation when power generation using the heat-generating component 22 is available.

Figure 3:
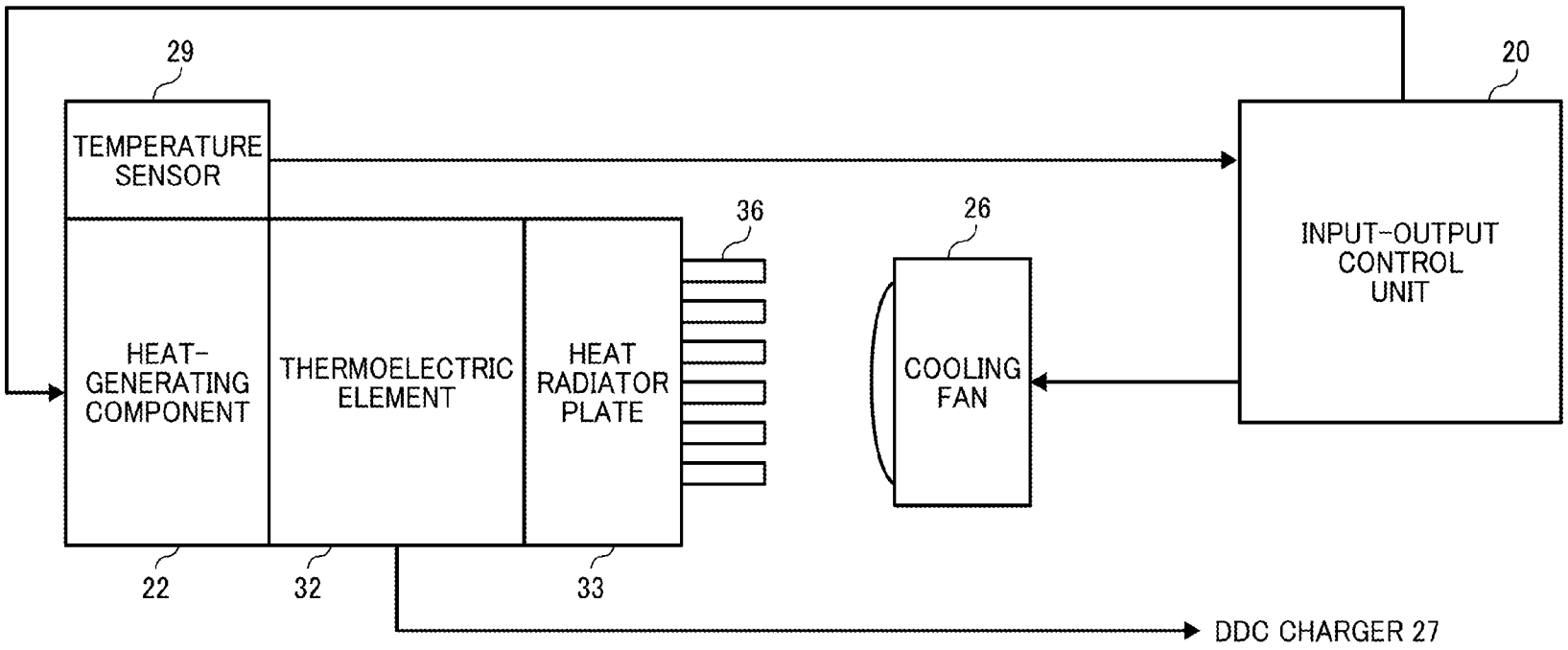
FIG. 3 RELATED ART
FIG. 3 is a schematic block diagram illustrating a power generation and cooling system according to an existing example, which uses a heat-generating component of the image forming apparatus illustrated in FIG. 1.

FIG. 3 is a schematic block diagram illustrating, as a comparative example, a power generation and cooling system according to an existing example, which uses the heat-generating component 22 of the image forming apparatus 1. As illustrated in FIG. 3, in the power generation and cooling system according to the existing example using the heat-generating component 22, the thermoelectric element 32 generates power with one surface thereof in contact with the heat-generating component 22 and the other surface thereof attached to an air-cooled radiator plate 33. The input-output control unit 20 controls the operation of the cooling fan 26 to perform a cooling operation based on the temperature increase detected by the temperature sensor 29 attached to the heat-generating component 22.

In this example, as the heat-generating component 22 operates and generates heat in the image forming apparatus 1, the heat is transmitted to the thermoelectric element 32, and the thermoelectric element 32 generates power. In this process, the heat transmitted to the thermoelectric element 32 is radiated into the air through the air-cooled radiator plate 33. If the temperature increase of the heat-generating component 22 detected by the temperature sensor 29 is small, the heat-generating component 22 is unlikely to be destroyed by the increased temperature even if the cooling fan 26 is not operated. On the other hand, if the detected temperature increase is large owing to a continuous operation of the heat-generating component 22 in a certain use state of the image forming apparatus 1, for example, the cooling performance is insufficient. To prevent the destruction of the heat-generating component 22, therefore, it is necessary to operate the cooling fan 26 and apply cool air to heat radiation fins 36 and the body of the radiator plate 33 to enhance the cooling performance.

When power generation takes place in the thermoelectric element 32 in contact with the heat-generating component 22, a high thermal resistance of the thermoelectric element 32 should be taken into account, as well as the cooling function of the heat-generating component 22. Compared with a configuration not having the thermoelectric element 32 between the heat-generating component 22 and the radiator plate 33, in the configuration having the thermoelectric element 32 between the heat-generating component 22 and the radiator plate 33 and including the cooling fan 26 having the same level of cooling performance as that of the configuration not having the thermoelectric element 32, it is difficult to cool the heat-generating component 22 because of the thermal resistance of the thermoelectric element 32. Therefore, the function of cooling the heat-generating component 22 is inhibited, and at worst elements in the heat-generating component 22 may be destroyed owing to the temperature increase. To prevent such destruction of the heat-generating component 22, it is conceivable to increase the airflow volume of the cooling fan 26. The increase of the airflow volume, however, entails a substantial increase in power necessary for the cooling operation, which is undesirable in view of the recent demand for energy efficiency.

In this disclosure, therefore, two types of radiator plates are provided, and cooling methods are switched in accordance with the use state of the image forming apparatus 1.

Figure 4:
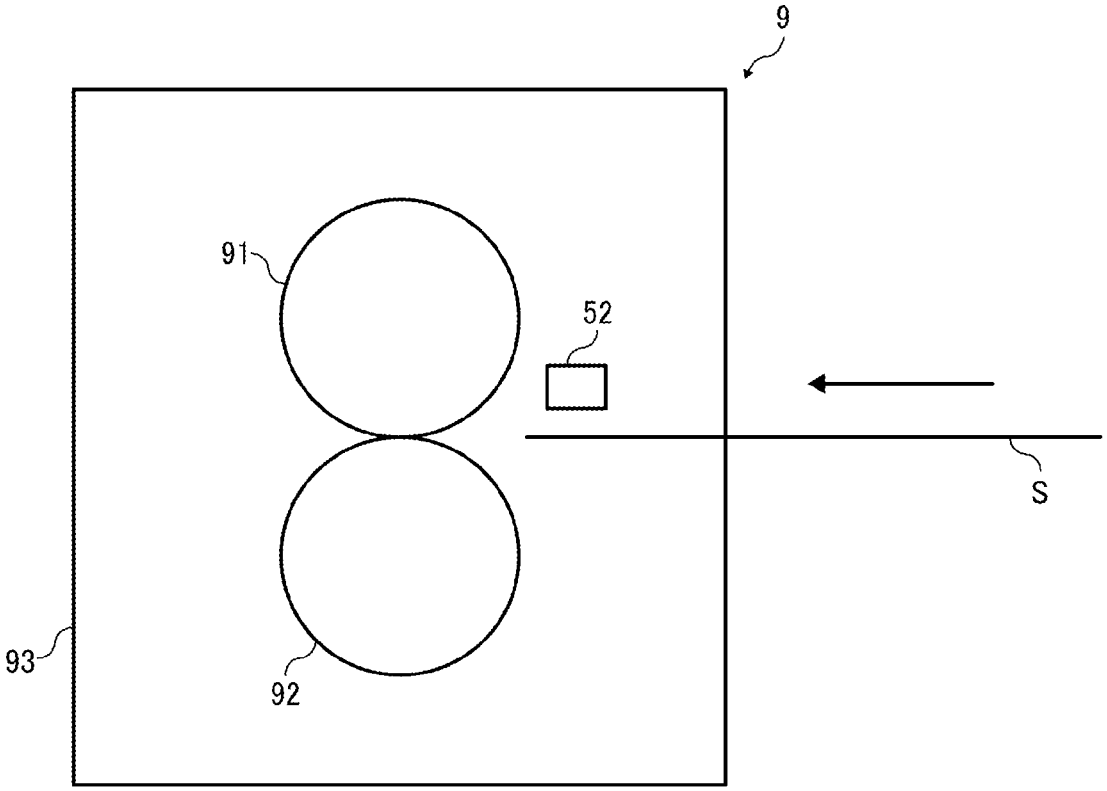
FIG. 4 is a schematic diagram illustrating the structure of the heat-generating component of the image forming apparatus illustrated in FIG. 1.

FIG. 4 is a diagram illustrating the structure of the heat-generating component 22 of the image forming apparatus 1. The fixing device 9 includes a fixing roller 91 and a pressure roller 92, which are typically disposed in a casing 93. A transfer sheet S passes between the fixing roller 91 and the pressure roller 92 that axially rotate. In this process, the transfer sheet S is heated by the fixing roller 91 and pressed against the pressure roller 92, and thereby toner on the transfer sheet S is fused and fixed thereon. A temperature sensor 52 is disposed in the fixing device 9 to measure the temperature of the fixing roller 91. The temperature sensor 52 may be employed as the temperature sensor 29 in FIG. 2.

Figure 5:
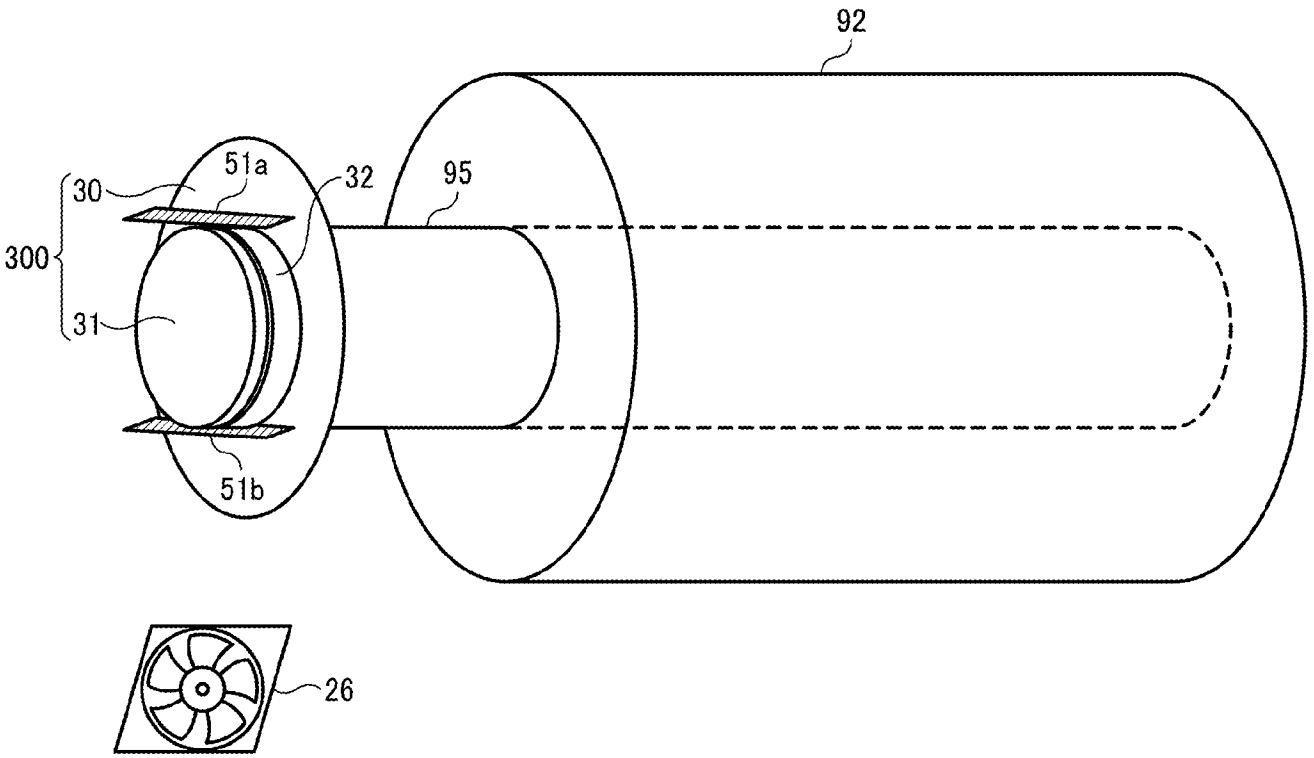
FIG. 5 is a diagram illustrating the structure of a pressure roller illustrated in FIG. 4.

FIG. 5 is a diagram illustrating details of the structure of the pressure roller 92 illustrated in FIG. 4. The first radiator plate 30, the thermoelectric element 32, and the second radiator plate 31 are provided to the pressure roller 92. The following description is given on the assumption that, in the present embodiment, the heat-generating component 22 illustrated in FIG. 2 corresponds to the fixing device 9, more specifically to the pressure roller 92 that receives the heat from the fixing roller 91.

The fixing roller 91 has a shaft including a heater. The heat generated by the heater is conducted to the pressure roller 92 from the fixing roller 91. The pressure roller 92 has a rotary shaft formed of a heat pipe 95. The heat conducted to the pressure roller 92 from the fixing roller 91 is further conducted to the heat pipe 95 and guided to the first radiator plate 30 by the heat pipe 94.

The first radiator plate 30 is fixed to the heat pipe 95, and thus rotates together with the heat pipe 95. Although the first radiator plate 30 in the present embodiment has a circular shape, the shape of the first radiator plate 30 is not limited thereto.

The thermoelectric element 32 is disposed on a surface of the first radiator plate 30 opposite the surface facing the pressure roller 92. The thermoelectric element 32 has a circular shape having a smaller diameter than that of the first radiator plate 30. The diameter of the thermoelectric element 32, however, may be determined to a desired value. Further, the thermoelectric element 32 may be a commonly used thermoelectric element.

The second radiator plate 31 is disposed on a surface of the thermoelectric element 32 opposite the surface facing the first radiator plate 30. The second radiator plate 31 may be provided with heat radiation fins.

The thermoelectric element 32 has a function of converting the received heat into electricity. On the circumferential surface of the thermoelectric element 32, a pair of electrodes 51*a* and 51*b* are disposed to extract the electricity from the thermoelectric element 32. The electrodes 51*a* and 51*b* are connected to the DDC charger 27 illustrated in FIG. 2.

When the temperature of the fixing roller 91 is measured by the temperature sensor 29 (i.e., the temperature sensor 52), these temperature readings are supplied to the CPU 201. When the increase in temperature of the fixing roller 91 equals or exceeds a predetermined threshold value, the CPU 201 drives the cooling fan 26. Conversely, if the increase in temperature of the fixing roller 91 is less than the predetermined threshold value, the CPU 201 does not drive the cooling fan 26 but instead allows the first radiator plate 30 to cool passively, through so-called passive cooling. In this process, the thermoelectric element 32 generates power.

That is, the present embodiment employs two types of cooling methods; a method of cooling the first radiator plate 30 with the cooling fan 26 and a method of cooling the second radiator plate 31 through passive cooling.

If the temperature increase of the heat-generating component 22 according to the use state of the image forming apparatus 1 detected by the temperature sensor 29 is small and less than the predetermined threshold value, the temperature increase due to the heat generation is small enough not to cause the destruction of the heat-generating component 22. Therefore, the input-output control unit 20 does not operate the cooling fan 26 but instead allows cooling of the heat generating component 22 only through passive cooling of the second heat radiator plate 31. In this process, the heat from the heat-generating component 22 is conducted to the first radiator plate 30 having a high thermal conductivity and then is transmitted to the thermoelectric element 32. The heat transmitted to the thermoelectric element 32 is passively cooled and radiated from the second radiator plate 31. Since the cooling fan 26 is not operating during this process, the heat generation takes place in the thermoelectric element 32 with no need for power for operating the cooling fan 26. The temperature increase of the heat-generating component 22 is less than the predetermined threshold value in, for example, the production of a small number of prints, which accounts for a large proportion of the operations of the image forming apparatus 1. In such an operation, therefore, efficient heat generation takes place in the thermoelectric element 32 without the operation of the cooling fan 26, i.e., without the consumption of power for the cooling operation.

If the temperature increase of the heat-generating component 22 according to the use state of the image forming apparatus 1 detected by the temperature sensor 29 is large and equal to or greater than the predetermined threshold value, the temperature increase due to the heat generation is large enough to raise the possibility of destroying the heat-generating component 22. Therefore, the input-output control unit 20 operates the cooling fan 26 to actively apply the cool air from the cooling fan 26 to the first radiator plate 30, to thereby radiate the heat from the heat-generating component 22 through the first radiator plate 30. In the present configuration, the thermoelectric element 32 having a high thermal resistance is not interposed between the heat-generating component 22 and the first radiator plate 30. Therefore, the installation of the thermoelectric element 32 does not increase the power for the cooling operation, thereby allowing efficient cooling.

Figure 6:
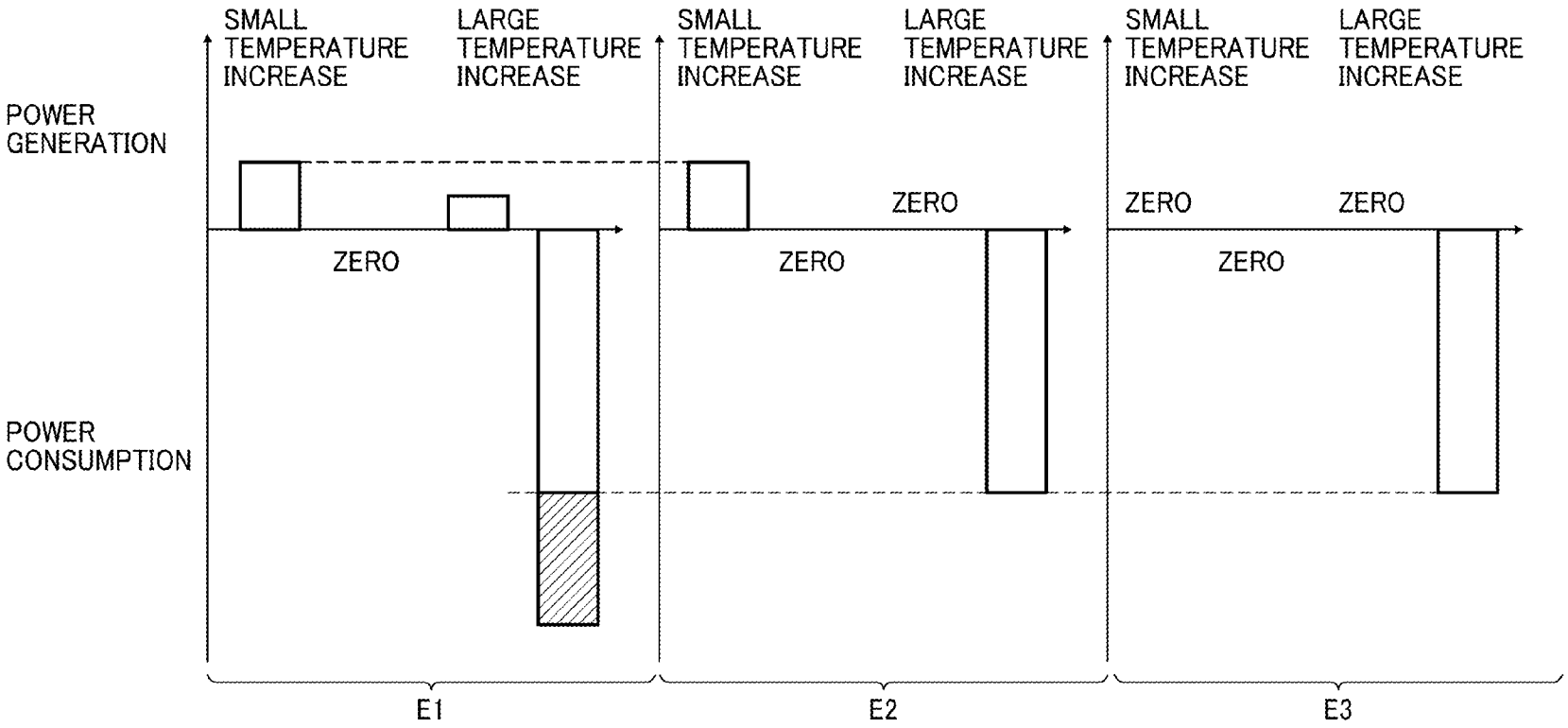
FIG. 6 is a diagram comparing power generation and consumption of the heat-generating component of the image forming apparatus according to the temperature increase between the power generation and cooling system of the existing example illustrated in FIG. 3, the power generation and cooling system of the first embodiment illustrated in FIG. 5, and a cooling system without a heat generation system.

FIG. 6 is a diagram comparing power generation and consumption of the heat-generating component 22 of the image forming apparatus 1 according to the temperature increase between the power generation and cooling system of the existing example illustrated in FIG. 3, the power generation and cooling system of the first embodiment illustrated in FIG. 5, and a cooling system without a heat generation system, which corresponds to charts E1, E2, and E3, respectively In general, the production of a small number of prints accounts for a large proportion of the operations performed by the image forming apparatus 1 used in an office or the like. In such an operation, the image forming apparatus 1 shifts to a standby mode or a sleep mode after printing, and the flow of current to the heat-generating component 22 stops, halting the temperature increase of the heat-generating component 22. In such production of a small number of prints, although the current temporarily flows through the heat-generating component 22 and increases the temperature thereof, the operating time of the image forming apparatus 1 is short due to the small number of prints. Consequently, the current flow stops before the temperature reaches the upper limit, thereby reducing the temperature. Due to the power generation by the thermoelectric element 32 during the repetition of such an operation, small power generation amounts accumulate, producing an energy saving effect.

In some cases, however, the image forming apparatus 1 produces a large number of prints. In this case, the current flows through the heat-generating component 22 for an extended time, increasing the temperature of the heat-generating component 22. Then, if the cooling performance is surpassed by the temperature increase, the temperature of the elements in the heat-generating component 22 continues to increase, eventually exceeding the upper limit thereof and destroying the heat-generating component 22. Forced cooling by the cooling fan 26 is necessary to prevent such an outcome, but the operation of the cooling fan 26 means an increase in power consumption.

As illustrated in FIG. 6, in the power generation and cooling system according to the existing example in chart E1, if the temperature increase of the elements in the heat-generating component 22 is small, the thermoelectric element 32 is capable of generating power while the heat of the heat-generating component 22 is radiated through the radiator plate 33. If the temperature increase is thus small, the thermoelectric element 32 is capable of generating power without the operation of the cooling fan 26, although the power generation amount is small. Accordingly, a predetermined power generation amount is obtained without power consumption for the cooling operation.

If the temperature increase is large, however, it is necessary to operate the cooling fan 26. In this example, the thermoelectric element 32 having a high thermal resistance is interposed between the heat-generating component 22 and the radiator plate 33, and thus the power consumption for the cooling operation is substantially increased compared with that in the cooling system without a heat generation system (i.e., without the thermoelectric element 32) in chart E3. FIG. 6 illustrates that, when the temperature increase is large in this existing example, the thermoelectric element 32 generates approximately half the predetermined power generation amount with the power consumption for the cooling operation excluding the increment indicated by hatching. Without this increment in the power consumption for the cooling operation, the elements in the heat-generating component 22 are likely to be destroyed when the temperature increase is large.

On the other hand, in the heat generation and cooling system according to the first embodiment in chart E2, if the temperature increase of the elements in the heat-generating component 22 is small, the heat from the heat-generating component 22 is conducted to the first radiator plate 30 having a high thermal conductivity and then is transmitted to the thermoelectric element 32. The heat transmitted to the thermoelectric element 32 is radiated from the second radiator plate 31 and passively cooled. Accordingly, the predetermined power generation amount is obtained from the power generation by the thermoelectric element 32. Since the cooling fan 26 is not operating during this process, there is no power consumption for the cooling operation.

If the temperature increase is large, the cooling fan 26 is operated to actively apply the cool air to the first radiator plate 30. Thereby, the heat of the heat-generating component 22 is radiated through the first radiator plate 30. In the present embodiment, the cool air produced by the operation of the cooling fan 26 is used for the cooling operation. Unlike the heat generation and cooling system according to the existing example in chart E1, however, the thermoelectric element 32 having a high thermal resistance is not interposed between the heat-generating component 22 and the first radiator plate 30 in the present embodiment, and thus there is no increase in the power consumption for the cooling operation. When the temperature increase is large, therefore, the power consumption for the cooling operation, i.e., for the operation of the cooling fan 26 is approximately the same as that in the cooling system without a heat generation system (i.e., without the thermoelectric element 32) in chart E3.

A second embodiment of this disclosure will now be described.

According to the second embodiment, the image forming apparatus 1 does not include the temperature sensor 29 attached to the heat-generating component 22 to detect the temperature increase of the heat-generating component 22. Instead, the input-output control unit 20 predicts the temperature increase of the heat-generating component 22 from the control state of the image forming apparatus 1, which is assumed to be related to the temperature increase of the heat-generating component 22. Further, the input-output control unit 20 controls the operations of the cooling fan 26 and the thermoelectric element 32 by operating the cooling fan 26 if the predicted temperature increase equals or exceeds a predetermined threshold value, and causing the thermoelectric element 32 to generate power without operating the cooling fan 26 to cool the first radiator plate 30 through passive cooling if the predicted temperature increase is less than the predetermined threshold value.

That is, in the image forming apparatus 1 according to the second embodiment, the input-output control unit 20 calculates the heat generation amount based on, for example, the amount of current flowing through the heat-generating component 22 and the length of time the current flow detected from the control state of the image forming apparatus 1, and predicts the temperature increase based on the heat generation amount. The present embodiment obviates the need for installing the special temperature sensor 29 to the heat-generating component 22, thereby achieving a reduction in cost.

A third embodiment of this disclosure will now be described.

The image forming apparatus 1 according to the third embodiment is an embodiment of the second embodiment. In the image forming apparatus 1 according to the third embodiment, the print number detector (i.e., the CPU 201) detects, as an example of the control state of the image forming apparatus 1, the number of prints to be produced by the image forming apparatus 1. The input-output control unit 20 predicts the temperature increase of the heat-generating component 22 based on the number of prints detected by the print number detector, and controls the operations of the cooling fan 26 and the thermoelectric element 32 in accordance with the predicted temperature increase. Specifically, the input-output control unit 20 operates the cooling fan 26 if the predicted temperature increase equals or exceeds a predetermined threshold value, and causes the thermoelectric element 32 to generate power without operating the cooling fan 26 to cool the first radiator plate 30 through passive cooling if the predicted temperature increase is less than the predetermined threshold value.

The image forming apparatus 1 according to the third embodiment obviates the need for installing the special temperature sensor 29 to the heat-generating component 22 similarly to the second embodiment, thereby achieving a reduction in cost. Further, the present embodiment allows the thermoelectric element 32 to generate power without the operation of the cooling fan 26 when the temperature of the heat-generating component 22 is not increased to the level at which the cooling by the cooling fan 26 is necessary, such as the production of a small number of prints, which accounts for a large proportion of the operations performed by the image forming apparatus 1. Accordingly, an effect of allowing efficient power generation is also expected.

A fourth embodiment of this disclosure will now be described.

The image forming apparatus 1 according to the fourth embodiment is an embodiment variation of the second embodiment. In the image forming apparatus 1 according to the fourth embodiment, the sheet thickness detector (i.e., the CPU 201) that detects, as an example of the control state of the image forming apparatus 1, the thickness of a sheet to be printed by the image forming apparatus 1. The input-output control unit 20 predicts the temperature increase of the heat-generating component 22 based on the thickness of the sheet detected by the sheet thickness detector, and controls the operations of the cooling fan 26 and the thermoelectric element 32 in accordance with the predicted temperature increase. Specifically, the input-output control unit 20 operates the cooling fan 26 if the predicted temperature increase equals or exceeds a predetermined threshold value, and causes the thermoelectric element 32 to generate power without operating the cooling fan 26 to cool the first radiator plate 30 through passive cooling if the predicted temperature increase is less than the predetermined threshold value.

In the image forming apparatus 1 according to the fourth embodiment, the temperature increase is predictable based on the ON time of the heat-generating component 22 and the value of the current flowing through the heat-generating component 22 during the ON time, which are detected from the thickness of the sheet detected and output by the sheet thickness detector. The present embodiment therefore obviates the need for installing the special temperature sensor 29 to the heat-generating component 22 similarly to the second embodiment, thereby achieving a reduction in cost.

A fifth embodiment of this disclosure will now be described.

The image forming apparatus 1 according to the fifth embodiment is yet another variation of the second embodiment. In the image forming apparatus 1 according to the fifth embodiment, the print mode recognition device (i.e., the CPU 201) recognizes, as an example of the control state of the image forming apparatus 1, a print mode of the image forming apparatus 1. The input-output control unit 20 predicts the temperature increase of the heat-generating component 22 based on the print mode recognized by the print mode recognition device, and controls the operations of the cooling fan 26 and the thermoelectric element 32 in accordance with the predicted temperature increase. Specifically, the input-output control unit 20 operates the cooling fan 26 if the predicted temperature increase equals or exceeds a predetermined threshold value, and causes the thermoelectric element 32 to generate power without operating the cooling fan 26 to cool the first radiator plate 30 through passive cooling if the predicted temperature increase is less than the predetermined threshold value.

In the image forming apparatus 1 according to the fifth embodiment, the temperature increase is predictable based on the ON time of the heat-generating component 22 and the value of the current flowing through the heat-generating component 22 during the ON time, which are detected from the print mode (e.g., monochrome or color) recognized and output by the print more recognition device. The present embodiment therefore obviates the need for installing the special temperature sensor 29 to the heat-generating component 22 similarly to the second embodiment, thereby achieving a reduction in cost.

An image forming apparatus according to an embodiment of this disclosure includes a heat radiation device including a first radiator plate interposed between a heat-generating component and one surface of a thermoelectric element and a second radiator plate attached to the other surface of the thermoelectric element. Further, the image forming apparatus includes a controller that controls operations of a cooling device of the image forming apparatus and the thermoelectric element by operating the cooling device if a temperature increase of the heat-generating component detected by a temperature detector or predicted from a control state of the image forming apparatus assumed to be related to the temperature increase equals or exceeds a predetermined threshold value, and causing the thermoelectric element (i.e., a power generation device) to generate power without operating the cooling device to cool the first heat radiator plate passively if the detected or predicted temperature increase is less than the predetermined threshold value.

Even with the structure having the thermoelectric element installed to the heat-generating component, therefore, the image forming apparatus has a function of cooling the heat-generating component and generating power from the heat-generating component, while allowing efficient cooling of the heat-generating component without degrading the heat radiation performance of the heat-generating component or increasing the power consumption for a cooling operation. Consequently, the destruction of the heat-generating component due to degraded heat radiation performance is prevented.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, this disclosure may be practiced otherwise than as specifically described herein.

What is claimed is:

1. An image forming apparatus comprising:

a heat-generating component;

a power generation device including a thermoelectric element;

a heat radiation device including a first radiator plate interposed between the heat-generating component and a first surface of the thermoelectric element and a second radiator plate attached to a second surface of the thermoelectric element opposite the first surface;

a cooling device configured to cool the first radiator plate;

a temperature detector configured to detect a temperature increase of the heat-generating component; and a controller configured to operate the cooling device to actively cool the first radiator plate if the detected increased temperature reaches at least a threshold value, and stop operating the cooling device to passively cool the first radiator plate through allowing the heat to transmit from the first radiator plate to the second radiator plate via the power generation device if the detected increased temperature falls below the threshold value, wherein the heat-generating component is a pressure roller, wherein the pressure roller has a rotary shaft formed of a heat pipe, and wherein the heat pipe is fixed to the first radiator plate to guide the heat towards the first radiator plate.

2. The image forming apparatus according to claim 1, wherein the first radiator plate has a thermal conductivity higher than that of the second radiator plate.

3. The image forming apparatus according to claim 1, wherein the first radiator plate has at least a portion directly facing the cooling device.

4. The image forming apparatus according to claim 1, wherein the first radiator plate, the thermoelectric element, and the second radiator plate are arranged in consecutive order.

5. The image forming apparatus according to claim 1, wherein the controller operates the cooling device to directly cool the heat-generating component via the power generation device.

6. The image forming apparatus according to claim 1, wherein the first radiator plate is fixed to and rotates with the heat-generating component.

7. The image forming apparatus according to claim 1, wherein the first radiator plate and the second radiator plate are circular in shape.

8. The image forming apparatus according to claim 1, wherein the thermoelectric element is circular in shape.

9. The image forming apparatus according to claim 8, wherein the thermoelectric element has a smaller diameter than a diameter of the first radiator plate.

10. The image forming apparatus according to claim 8, further comprising a pair of electrodes on a circumferential surface of the thermoelectric element.

11. The image forming apparatus according to claim 10, wherein the pair of electrodes are connected to a direct-current converter (DDC) charger.

12. The image forming apparatus according to claim 1, wherein the thermoelectric element has a similar shape as the first radiation radiator plate.

13. The image forming apparatus according to claim 1, wherein the thermoelectric element has a similar shape as the second radiator plate.

14. An image forming apparatus comprising:

a heat-generating component;

a power generation device including a thermoelectric element;

a heat radiation device including a first radiator plate interposed between the heat-generating component and a first surface of the thermoelectric element and a second radiator plate attached to a second surface of the thermoelectric element opposite the first surface;

a cooling device configured to cool the first radiator plate; and a controller configured to predict a temperature increase of the heat-generating component from a control state of the image forming apparatus related to the temperature increase, and to operate the cooling device to actively cool the first radiator plate if the predicted increased temperature reaches at least a threshold value, and stop operating the cooling device to passively cool the first radiator plate through allowing the heat to transmit from the first radiator plate to the second radiator plate via the power generation device if the predicted increased temperature falls below the threshold value, wherein the heat-generating component is a pressure roller, wherein the pressure roller has a rotary shaft formed of a heat pipe, and wherein the heat pipe is fixed to the first radiator plate to guide the heat towards the first radiator plate.

15. The image forming apparatus according to claim 14, wherein the control state of the image forming apparatus indicates a number of prints to be produced by the image forming apparatus.

16. The image forming apparatus according to claim 14, wherein the control state of the image forming apparatus indicates a thickness of a sheet to be printed by the image forming apparatus.

17. The image forming apparatus according to claim 14, wherein the control state of the image forming apparatus indicates a print mode of the image forming apparatus.

18. An image forming apparatus comprising:

a heat-generating component;

a power generation device including a thermoelectric element;

a heat radiation device including a first radiator plate interposed between the heat-generating component and a first surface of the thermoelectric element and a second radiator plate attached to a second surface of the thermoelectric element opposite the first surface;

a cooling device configured to cool the first radiator plate;

a temperature detector configured to detect a temperature increase of the heat-generating component; and a controller configured to operate the cooling device to actively cool the first radiator plate if the detected increased temperature reaches at least a threshold value, and stop operating the cooling device to passively cool the first radiator plate through allowing the heat to transmit from the first radiator plate to the second radiator plate via the power generation device if the detected increased temperature falls below the threshold value, wherein the first radiator plate is fixed to and rotates with the heat-generating component.

* * * * *